US011534883B2

(12) United States Patent
Zhang et al.

(10) Patent No.: US 11,534,883 B2
(45) Date of Patent: Dec. 27, 2022

(54) WHEEL CONFORMAL BURR BRUSHING DEVICE

(71) Applicant: CITIC Dicastal CO., LTD., Hebei (CN)

(72) Inventors: Yacong Zhang, Qinhuangdao (CN); Bowen Xue, Qinhuangdao (CN); Hongbao Wang, Qinhuangdao (CN); Jiandong Guo, Qinhuangdao (CN)

(73) Assignee: CITIC Dicastal CO., LTD., Qinhuangdao (CN)

( * ) Notice: Subject to any disclaimer, the term of this patent is extended or adjusted under 35 U.S.C. 154(b) by 839 days.

(21) Appl. No.: 16/508,180

(22) Filed: Jul. 10, 2019

(65) Prior Publication Data

US 2020/0147744 A1 May 14, 2020

(30) Foreign Application Priority Data

Nov. 12, 2018 (CN) ..... 201811338130.0

(51) Int. Cl.

| | |
|---|---|
| ***B24B 9/04*** | (2006.01) |
| ***B24B 41/06*** | (2012.01) |
| ***B24B 47/12*** | (2006.01) |
| ***B24B 47/22*** | (2006.01) |
| ***B24B 5/44*** | (2006.01) |

(52) U.S. Cl.

CPC ..... *B24B 9/04* (2013.01); *B24B 5/44* (2013.01); *B24B 41/06* (2013.01); *B24B 47/12* (2013.01); *B24B 47/22* (2013.01)

(58) Field of Classification Search

CPC .. B24B 5/16; B24B 5/165; B24B 5/44; B24B 9/02; B24B 9/04; B24B 27/0076; B24B 27/0069; B24B 29/005; B24B 29/04; B24B 47/12; B24B 47/22; B24B 41/005; B24B 41/02; B24B 41/06

USPC ..... 451/65, 178, 294

See application file for complete search history.

(56) References Cited

U.S. PATENT DOCUMENTS

| | | | | |
|---|---|---|---|---|
| 11,383,343 | B2 * | 7/2022 | Zhou | B24B 49/003 |
| 2016/0288282 | A1 * | 10/2016 | Liu | B60B 27/00 |
| 2016/0354891 | A1 * | 12/2016 | Xue | B24B 29/005 |
| 2017/0182617 | A1 | 6/2017 | Xue et al. | |
| 2017/0182619 | A1 * | 6/2017 | Xue | B24B 9/04 |
| 2018/0001436 | A1 | 1/2018 | Xue et al. | |
| 2018/0264617 | A1 * | 9/2018 | Xue | B24B 29/04 |
| 2019/0193234 | A1 * | 6/2019 | Xue | B24B 5/44 |
| 2020/0139502 | A1 * | 5/2020 | Wu | B24B 5/44 |
| 2020/0139504 | A1 * | 5/2020 | Li | B24B 9/04 |
| 2020/0139505 | A1 * | 5/2020 | Xue | B24B 29/005 |
| 2020/0147743 | A1 * | 5/2020 | Zhang | B24B 41/005 |

OTHER PUBLICATIONS

Supplementary European Search Report in the European application No. 19201503.0, dated Jan. 30, 2020.

* cited by examiner

*Primary Examiner* — Orlando E Aviles
*Assistant Examiner* — Marcel T Dion
(74) *Attorney, Agent, or Firm* — Syncoda LLC; Feng Ma

(57) ABSTRACT

A wheel conformal burr brushing device includes a lower lifting driving system, a central burr brushing system, a lower gear lifting unit, first burr brushing systems, second burr brushing systems, a synchronous clamping driving system and an upper burr brushing system.

1 Claim, 4 Drawing Sheets

WHEEL CONFORMAL BURR BRUSHING DEVICE

CROSS-REFERENCE TO RELATED APPLICATION

The present application claims priority to Chinese Patent Application No. 201811338130.0, filed on Nov. 12, 2018, the contents of which are hereby incorporated by reference in their entirety.

BACKGROUND

Inevitably, many burrs may be generated on a back cavity of a wheel in a machining production process of the wheel, and if the burrs are not removed in time, the subsequent coating effect may be seriously affected, and the wheel may be corroded in a traveling process in advance so as to lose efficacy. In order to effectively remove the burrs on the back cavity of the wheel, a burr brush type device may be generally selected; mixed line production is adopted by most of production enterprises, so that wheels of which back cavities have different sizes and shapes alternatively operate on an assembly line; and at present, no automatic flexible deburring devices are capable of adapting to the shapes and sizes of the back cavities in the industry.

SUMMARY

The present disclosure relates to a burr brushing device and specifically relates to a wheel conformal burr brushing device.

The present disclosure aims at providing a wheel conformal burr brushing device which is not only capable of removing burrs on a back cavity and the obverse side of a wheel, but also capable of automatically regulating the postures of brushes according to the shape of the back cavity of the wheel when being used; in addition, the position of each of the brushes may be automatically regulated according to the size of the back cavity of the wheel.

In order to achieve the aim, the technical scheme of the present disclosure is that: a wheel conformal burr brushing device, comprising a rack, lower guide posts, lower guide sleeves, a first lower servo motor, a first lower fixed plate, a first belt wheel, a first synchronous belt, a second belt wheel, a lower lifting plate, a hollow shaft, a hollow bearing block, a second lower servo motor, a second lower fixed plate, first lower guide rails, first servo electric cylinders, sliding inclined blocks, sliding guide rails, fixed inclined blocks, a third lower fixed plate, first vertical plates, a fourth lower fixed plate, a first spline shaft, a first spline housing, a first lower bearing block, a lower gear, a central brush, an first upper air cylinder, an upper fixed plate, upper racks, an upper guide rail, a left sliding plate, left shafts, left bearing blocks, V-shaped rollers, an first upper brush, an first upper shaft, an first upper bearing block, an second upper brush, an second upper shaft, an second upper bearing block, an upper lifting plate, upper guide posts, upper guide sleeves, second upper air cylinder, an first servo motor, an third upper bearing block, an third upper shaft, an third upper brush, an upper gear, right shafts, right bearing blocks, a right sliding plate, an second servo motor, second servo electric cylinders, second lower guide rails, fifth lower fixed plates, first lower air cylinders, first rotating joints, second vertical plates, first fixed frames, second spline shafts, third belt wheels, second spline housings, sixth lower fixed plates, first crossed hinges, first lower brushes, second lower brushes, second crossed hinges, third spline shafts, third spline housings, second synchronous belt, fourth belt wheels, fifth belt wheels, sixth belt wheels, third synchronous belt, second rotating joints, second fixed frames, third lower servo motors, a first lower rack, second lower air cylinders, third lower guide rails, seventh lower fixed plates, first lower shafts, third vertical plates, second lower bearing blocks, an eighth lower fixed plate, coil springs, fourth lower guide rails, brush bundles, conformal support frames, third crossed hinges, lower slide blocks, third servo electric cylinders, fourth servo electric cylinders, fifth lower guide rails, a second lower rack.

The wheel conformal burr brushing device includes a lower lifting driving system, a central burr brushing system, a lower gear lifting unit, first burr brushing systems, second burr brushing systems, a synchronous clamping driving system and an upper burr brushing system.

The lower lifting driving system is characterized in that the four lower guide sleeves are fixedly arranged on the first lower fixed plate; the four lower guide posts matched with the four lower guide sleeves are fixedly arranged below the lower lifting plate; the two second servo electric cylinders are fixedly arranged below the first lower fixed plate, and the output ends of the two second servo electric cylinders are hinged with the downside of the lower lifting plate; the hollow bearing block is fixedly arranged above the lower lifting plate; the hollow shaft is mounted inside the hollow bearing block by using a bearing; the second lower fixed plate is fixedly arranged above the hollow shaft; the first belt wheel is fixedly arranged below the hollow shaft; the first lower servo motor is fixedly arranged below the lower lifting plate by using a transitional flange, and the output end of the first lower servo motor is fixedly provided with the second belt wheel; and the first belt wheel is connected with the second belt wheel by the first synchronous belt.

A central burr brushing system is characterized in that the second lower servo motor is fixedly arranged below the fixed inclined blocks; the third lower fixed plate is fixedly arranged above the fixed inclined blocks; the first lower bearing block is fixedly arranged on the third lower fixed plate; the first spline housing is mounted inside the first lower bearing block by using a bearing; the lower gear is fixedly arranged above the first spline housing; the first spline shaft is matched with the first spline housing; the central brush is fixedly arranged above the first spline shaft; and the output end of the second lower servo motor is connected with the lower end of the first spline shaft.

A lower gear lifting unit is characterized in that the sliding inclined blocks are mounted above the second lower fixed plate by the first lower guide rails; the first servo electric cylinders are fixedly arranged above the second lower fixed plate, and the output ends of the first servo electric cylinders are connected with the sliding inclined blocks; the sliding inclined blocks are connected with the fixed inclined blocks by the sliding guide rails; the fourth lower fixed plate is fixedly arranged above the second lower fixed plate by the first veridical plates; and the device includes the four sets of gear lifting units uniformly distributed in a circumferential direction.

The first burr brushing systems are characterized in that the fifth lower fixed plates are mounted above the fourth lower fixed plate by the second lower guide rails; the sixth lower fixed plates are fixedly arranged above the fifth lower fixed plates by the second vertical plates; the first fixed frames are fixedly arranged at the left sides below the sixth lower fixed plates; the second spline housings are mounted inside the first fixed frames by using bearings; the third belt wheels are fixedly arranged below the second spline housings; the second spline shafts are matched with the second spline housings; the first lower brushes are fixedly arranged at the top ends of the second spline shafts by using the first crossed hinges; the first rotating joints are fixedly arranged at the lower ends of the second spline shafts; the first lower air cylinders are fixedly arranged at the lower ends of the first fixed frames, and the output ends of the first lower air cylinders are connected with the downsides of the first rotating joints; the second fixed frames are fixedly arranged below the sixth lower fixed plates; the third spline housings are mounted inside the second fixed frames by using bearings; the fourth belt wheels and the fifth belt wheels are fixedly arranged below the third spline housings; the third belt wheels are connected with the fourth belt wheels by the second synchronous belt; the third spline shafts are matched with the third spline housings; the second lower brushes are fixedly arranged at the top ends of the third spline shafts by using the second crossed hinges; the second rotating joints are fixedly arranged at the lower ends of the third spline shafts; the second lower air cylinders are fixedly arranged below the second fixed frames, and the output ends of the second lower air cylinders are connected with the downsides of the second rotating joints; the third lower servo motors are fixedly arranged below the sixth lower fixed plates by the transitional flanges, and the output ends of the third lower servo motors are fixedly provided with the sixth belt wheels; the fifth belt wheels are connected with the sixth belt wheels by the third synchronous belt; the first lower rack is fixedly arranged above the fifth lower fixed plates and is engaged with the lower gear during working; and the device includes the two sets of bilateral first burr brushing systems.

The second burr brushing systems are characterized in that the seventh lower fixed plates are mounted above the fourth lower fixed plate by the third lower guide rails; the eighth lower fixed plate is fixedly arranged above the seventh lower fixed plates by the third vertical plates; the second lower bearing blocks are fixedly arranged on the eighth lower fixed plate; the first lower shafts are mounted inside the second lower bearing blocks by using bearings; the coil springs are fixedly arranged above the first lower shafts; the plurality of brush bundles are connected by the fourth lower guide rails; the plurality of brush bundles and the fourth lower guide rails are wound by the coil springs to form a round; the third servo electric cylinders are fixedly arranged on the eighth lower fixed plate; the conformal support frames are mounted at the output ends of the third servo electric cylinders by using the third crossed hinges; the upper ends of the lower slide blocks are connected with the lower ends of the brush bundles at the rightmost side; the lower ends of the lower slide blocks are mounted below the eighth lower fixed plate by the fifth lower guide rails; the fourth servo electric cylinders are fixedly arranged below the eighth lower fixed plate, and the output ends of the fourth servo electric cylinders are connected with the lower slide blocks; the second lower rack is fixedly arranged at the right sides above the seventh lower fixed plates and are engaged with the lower gear when working; and the device includes the two sets of bilateral second burr brushing systems.

The synchronous clamping driving system is characterized in that the left sliding plate and the right sliding plate are mounted above the upper fixed plate by the upper guide rail; the upper racks are respectively fixedly arranged below the left sliding plate and the right sliding plate; the upper gear is fixedly arranged above the upper fixed plate and is engaged with the upper racks; the first upper air cylinder is fixedly arranged above the upper fixed plate, and the output end of the first upper air cylinder is connected with the left sliding plate; the two left bearing blocks are fixedly arranged above the left sliding plate; the two left shafts are mounted inside the left bearing blocks by using bearings; the V-shaped rollers are respectively fixedly arranged above the two left shafts; the two right bearing blocks are fixedly arranged above the right sliding plate; the right shafts are mounted inside the right bearing blocks by using bearings; the V-shaped rollers are respectively fixedly arranged above the two right shafts; and the second servo motor is fixedly arranged below the right sliding plate, and the output end of the second servo motor is connected with one of the right shafts.

The upper burr brushing system is characterized in that the first upper bearing block is fixedly arranged on a middle position below the upper lifting plate; the first upper shaft is mounted inside the first upper bearing block by using a bearing; the first upper brush is fixedly arranged below the first upper shaft; the first servo motor is fixedly arranged on the upper lifting plate, and the output end of the first servo motor is connected with the upside of the first upper shaft; the second upper bearing block is fixedly arranged at the left side below the upper lifting plate; the second upper shaft is mounted inside the second upper bearing block by using a bearing; the second upper brush is fixedly arranged at the lower end of the second upper shaft; the third upper bearing block is fixedly arranged at the right side below the upper lifting plate; the third upper shaft is mounted inside the third upper bearing block by using a bearing; the third upper brush is fixedly arranged at the lower end of the third upper shaft; base plates of the first upper brush, the second upper brush and the third upper brush are shaped like gears, and the base plate of the first upper brush is simultaneously engaged with the base plates of the second upper brush and the third upper brush; the four upper guide sleeves are fixedly arranged at the top end of the rack; the four upper guide posts are engaged with the upper guide sleeves and are fixedly arranged at the upper end of the upper lifting plate; and the two second upper air cylinder are also fixedly arranged at the top end of the rack, and the output ends of the two second upper air cylinder are hinged with the upside of the upper lifting plate.

In a working process, the first upper air cylinder makes the four V-shaped rollers synchronously clamp the wheel by virtue of the upper guide rail, the upper gear and the upper racks; the second servo motor makes the clamped wheel rotate by virtue of one of the right shafts; the second servo electric cylinders make the first lower brushes and the second lower brushes lift to the back cavity of the wheel by virtue of the lower guide posts and the lower guide sleeves and also make the central brush lift to the inside of a central hole of the wheel; and the second lower servo motor makes the central brush rotate by virtue of the first spline shaft, at the moment, burrs at the central hole may be removed.

The first lower air cylinders make the first lower brushes be in conformal contact with corresponding positions of the back cavity of the wheel by virtue of the second spline shafts and the first crossed hinges; the second lower air cylinders make the second lower brushes be in conformal contact with corresponding positions of the back cavity of the wheel by virtue of the third spline shafts and the second crossed hinges; the third lower servo motors drive the third spline housings and the second lower brushes to rotate by virtue of the sixth belt wheels, the fifth belt wheels and the third synchronous belt; the third spline housings drive the fourth belt wheels to rotate; the fourth belt wheels drive the third belt wheels and the second spline housings to rotate by virtue of the second synchronous belt; and the second spline housings drive the first lower brushes to rotate.

According to the size of the back cavity of the wheel, the fourth servo electric cylinders make the brush bundles at the rightmost end move left and right by virtue of the fifth lower guide rails and the lower slide blocks; each of the brush bundles is tensioned by the coil spring during rightward movement; the brush bundles are automatically shrunk and tensioned by the coil springs during leftward movement; the third servo electric cylinders make the conformal support frames lift by virtue of the third crossed hinges; and the conformal support frames make the plurality of brush bundles lift by virtue of the fourth lower guide rails so that the shape of the back cavity of the wheel is adapted.

The first servo electric cylinders make the sliding inclined blocks move rightwards by virtue of the first lower guide rails; the sliding inclined blocks make the fixed inclined blocks and the lower gear move upwards by virtue of the sliding guide rails, and the lower gear is engaged with the first lower rack and the second lower rack; the second lower servo motor drives the first spline shaft to rotate; the first spline shaft drives the first spline housing and the lower gear to rotate; the left-right movement of the first lower brushes and the second lower brushes may be realized by virtue of the lower gear, the first lower rack and the second lower guide rails; the whole left-right movement of each of the brush bundles may be realized by virtue of the lower gear, the second lower rack and the third lower guide rails; and the rotation of the first lower brushes, the second lower brushes and each of the brush bundles in the circumferential direction may be realized by the first lower servo motor by virtue of the second belt wheel, the first belt wheel and the first synchronous belt.

The first servo motor makes the first upper brush rotate by virtue of the first upper shaft; the base plate of the first upper brush is simultaneously engaged with the base plates of the second upper brush and the third upper brush, so that the simultaneous rotation of the second upper brush and the third upper brush may be realized; and the second upper air cylinder are capable of making the first upper brush, the second upper brush and the third upper brush to move up and down by virtue of the upper guide posts and the upper guide sleeves, and thus, burrs on the obverse side may be removed when the obverse side of the wheel is contacted.

The wheel conformal burr brushing device is not only capable of removing the burrs on the back cavity and the obverse side of the wheel, but also capable of automatically regulating the postures of the brushes according to the shape of the back cavity of the wheel when being used; in addition, the position of each of the brushes may be automatically regulated according to the size of the back cavity of the wheel; and meanwhile, the wheel conformal burr brushing device has the characteristics of high automation degree, strong function, advanced process, high universality and safe and stable performance.

DETAILED DESCRIPTION

The details and working condition of a specific device proposed by the present disclosure are described below in combination with accompanying drawings.

Figure 1:
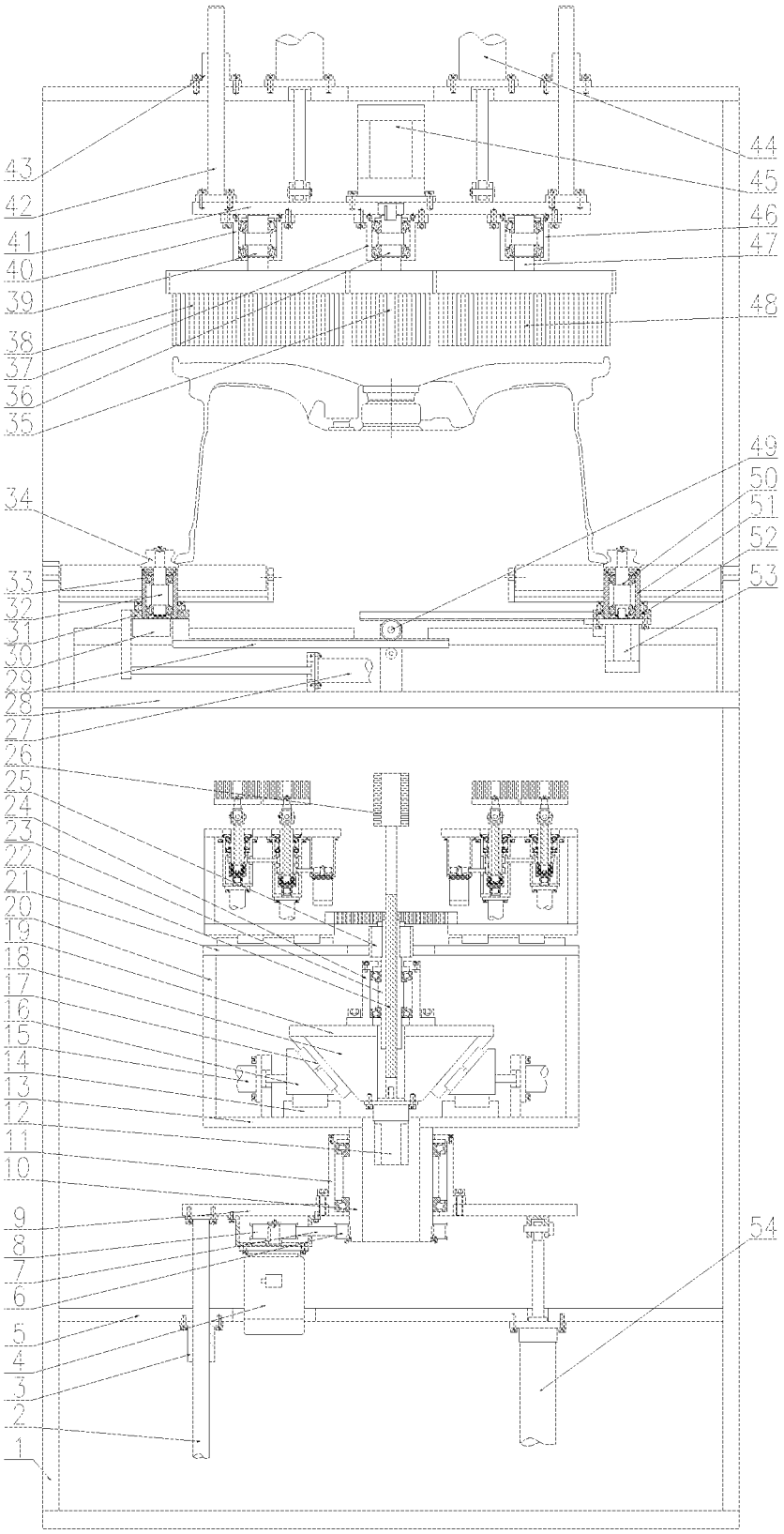
FIG. 1 is a main view of a wheel conformal burr brushing device provided by the present disclosure.
Figure 2:
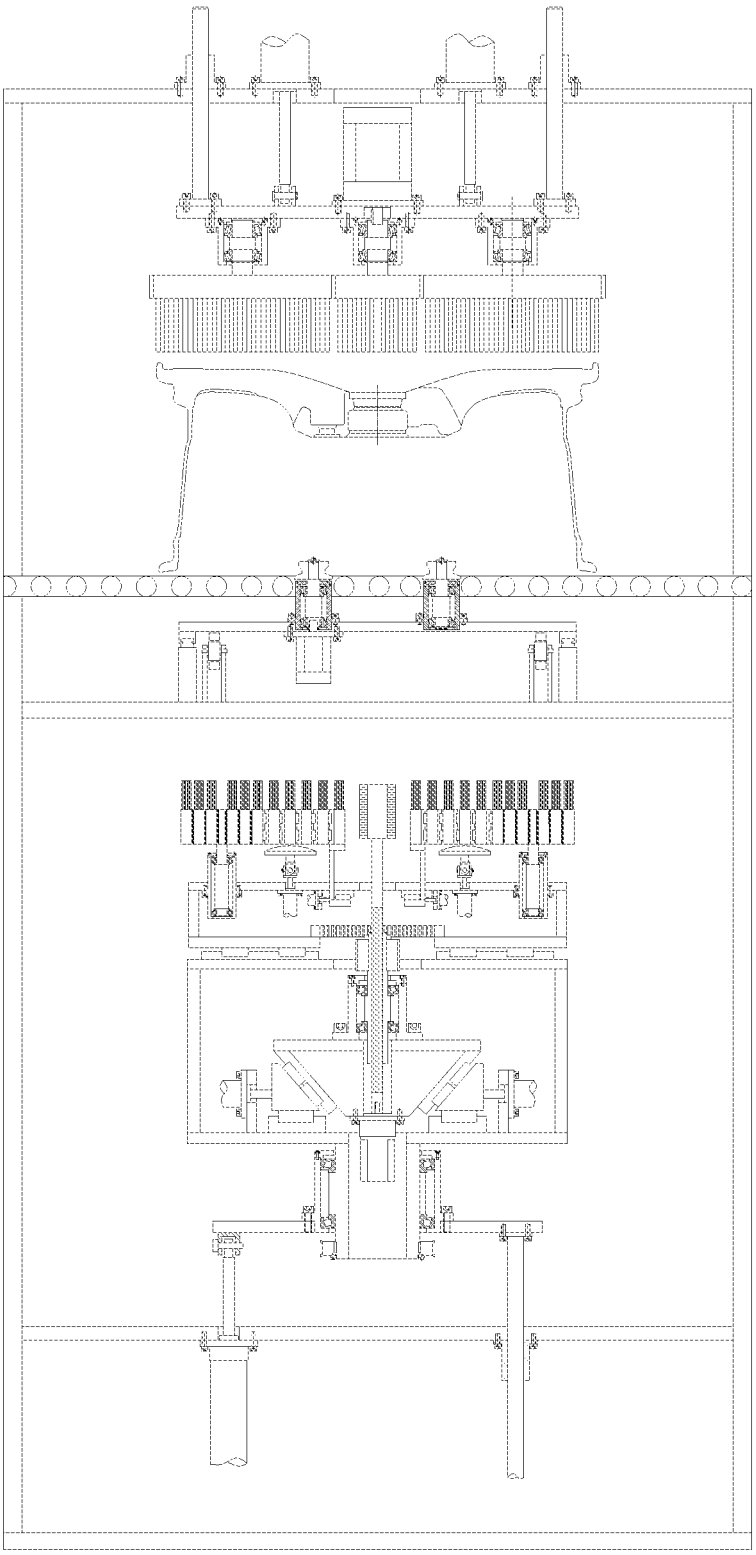
FIG. 2 is a left view of the present disclosure.
Figure 3:
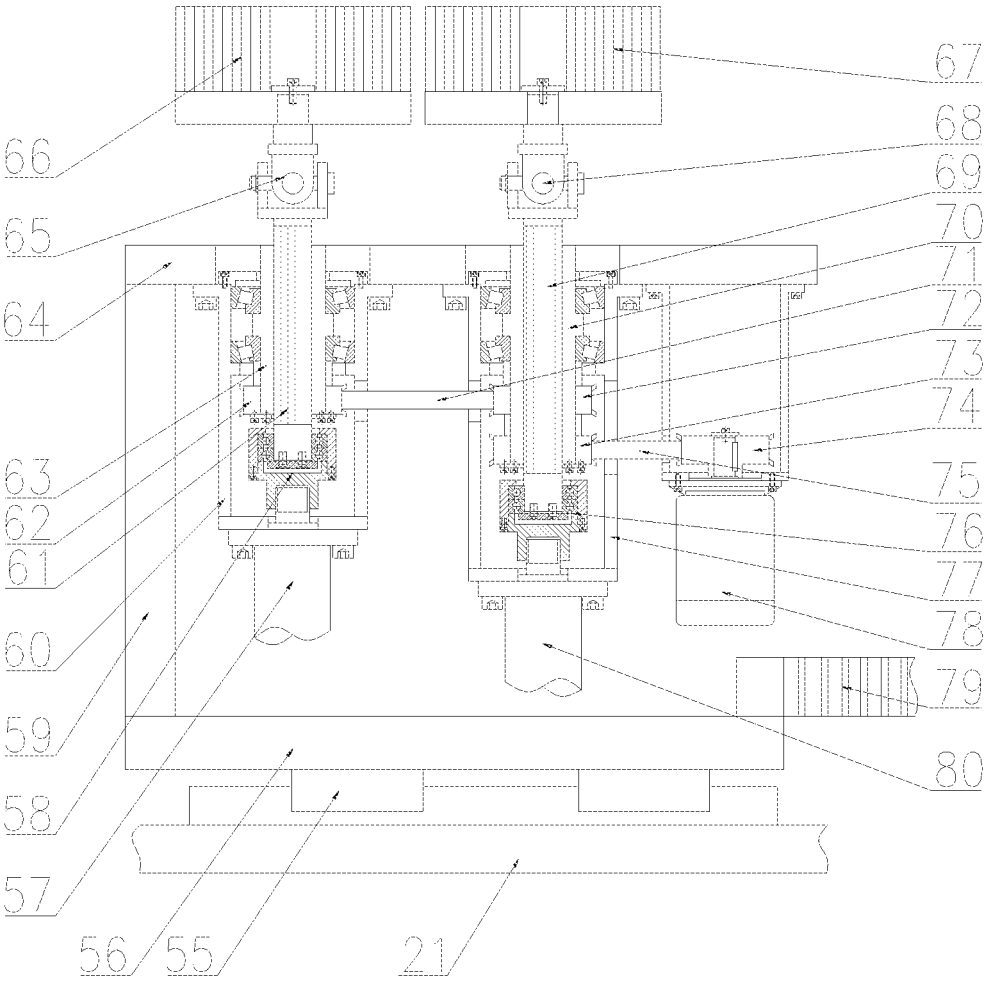
FIG. 3 is a main view of a first burr brushing system provided by the present disclosure.
Figure 4:
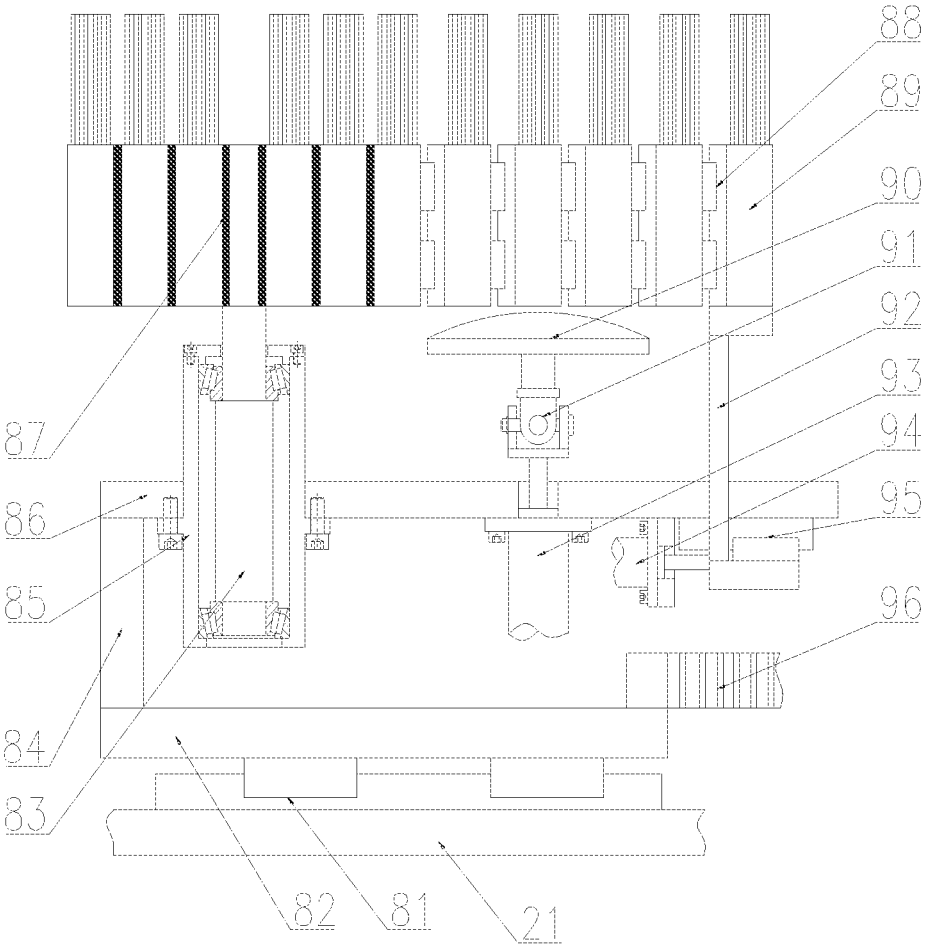
FIG. 4 is a main view of a second burr brushing system provided by the present disclosure.

As illustrated in FIGS. 1-4, the device can comprise a rack 1, lower guide posts 2, lower guide sleeves 3, a first lower servo motor 4, a first lower fixed plate 5, a first belt wheel 6, a first synchronous belt 7, a second belt wheel 8, a lower lifting plate 9, a hollow shaft 10, a hollow bearing block 11, a second lower servo motor 12, a second lower fixed plate 13, first lower guide rails 14, first servo electric cylinders 15, sliding inclined blocks 16, sliding guide rails 17, fixed inclined blocks 18, a third lower fixed plate 19, first vertical plates 20, a fourth lower fixed plate 21, a first spline shaft 22, a first spline housing 23, a first lower bearing block 24, a lower gear 25, a central brush 26, an first upper air cylinder 27, an upper fixed plate 28, upper racks 29, an upper guide rail 30, a left sliding plate 31, left shafts 32, left bearing blocks 33, V-shaped rollers 34, an first upper brush 35, an first upper shaft 36, an first upper bearing block 37, an second upper brush 38, an second upper shaft 39, an second upper bearing block 40, an upper lifting plate 41, upper guide posts 42, upper guide sleeves 43, second upper air cylinder 44, an first servo motor 45, an third upper bearing block 46, an third upper shaft 47, an third upper brush 48, an upper gear 49, right shafts 50, right bearing blocks 51, a right sliding plate 52, an second servo motor 53, second servo electric cylinders 54, second lower guide rails 55, fifth lower fixed plates 56, first lower air cylinders 57, first rotating joints 58, second vertical plates 59, first fixed frames 60, second spline shafts 61, third belt wheels 62, second spline housings 63, sixth lower fixed plates 64, first crossed hinges 65, first lower brushes 66, second lower brushes 67, second crossed hinges 68, third spline shafts 69, third spline housings 70, second synchronous belt 71, fourth belt wheels 72, fifth belt wheels 73, sixth belt wheels 74, third synchronous belt 75, second rotating joints 76, second fixed frames 77, third lower servo motors 78, a first lower rack 79, second lower air cylinders 80, third lower guide rails 81, seventh lower fixed plates 82, first lower shafts 83, third vertical plates 84, second lower bearing blocks 85, an eighth lower fixed plate 86, coil springs 87, fourth lower guide rails 88, brush bundles 89, conformal support frames 90, third crossed hinges 91, lower slide blocks 92, third servo electric cylinders 93, fourth servo electric cylinders 94, fifth lower guide rails 95, a second lower rack 96 and the like.

The wheel conformal burr brushing device includes a lower lifting driving system, a central burr brushing system, a lower gear lifting unit, first burr brushing systems, second burr brushing systems, a synchronous clamping driving system and an upper burr brushing system.

The lower lifting driving system is characterized in that the four lower guide sleeves 3 are fixedly arranged on the first lower fixed plate 5; the four lower guide posts 2 matched with the four lower guide sleeves 3 are fixedly arranged below the lower lifting plate 9; the two second servo electric cylinders 54 are fixedly arranged below the first lower fixed plate 5, and the output ends of the two second servo electric cylinders 54 are hinged with the downside of the lower lifting plate 9; the hollow bearing block 11 is fixedly arranged above the lower lifting plate 9; the hollow shaft 10 is mounted inside the hollow bearing block 11 by using a bearing; the second lower fixed plate 13 is fixedly arranged above the hollow shaft 10; the first belt wheel 6 is fixedly arranged below the hollow shaft 10; the first lower servo motor 4 is fixedly arranged below the lower lifting plate 9 by using a transitional flange, and the output end of the first lower servo motor 4 is fixedly provided with the second belt wheel 8; and the first belt wheel 6 is connected with the second belt wheel 8 by the first synchronous belt 7.

The central burr brushing system is characterized in that the second lower servo motor 12 is fixedly arranged below the fixed inclined blocks 18; the third lower fixed plate 19 is fixedly arranged above the fixed inclined blocks 18; the first lower bearing block 24 is fixedly arranged on the third lower fixed plate 19; the first spline housing 23 is mounted inside the first lower bearing block 24 by using a bearing; the lower gear 25 is fixedly arranged above the first spline housing 23; the first spline shaft 22 is matched with the first spline housing 23; the central brush 26 is fixedly arranged above the first spline shaft 22; and the output end of the second lower servo motor 12 is connected with the lower end of the first spline shaft 22.

The lower gear lifting unit is characterized in that the sliding inclined blocks 16 are mounted above the second lower fixed plate 13 by the first lower guide rails 14; the first servo electric cylinders 15 are fixedly arranged above the second lower fixed plate 13, and the output ends of the first servo electric cylinders 15 are connected with the sliding inclined blocks 16; the sliding inclined blocks 16 are connected with the fixed inclined blocks 18 by the sliding guide rails 17; the fourth lower fixed plate 21 is fixedly arranged above the second lower fixed plate 13 by the first veridical plate 20; and the device includes the four sets of gear lifting units uniformly distributed in a circumferential direction.

The first burr brushing systems are characterized in that the fifth lower fixed plates 56 are mounted above the fourth lower fixed plate 21 by the second lower guide rails 55; the sixth lower fixed plates 64 are fixedly arranged above the fifth lower fixed plates 56 by the second vertical plates 59; the first fixed frames 60 are fixedly arranged at the left sides below the sixth lower fixed plates 64; the second spline housings 63 are mounted inside the first fixed frames 60 by using bearings; the third belt wheels 62 are fixedly arranged below the second spline housings 63; the second spline shafts 61 are matched with the second spline housings 63; the first lower brushes 66 are fixedly arranged at the top ends of the second spline shafts 61 by using the first crossed hinges 65; the first rotating joints 58 are fixedly arranged at the lower ends of the second spline shafts 61; the first lower air cylinders 57 are fixedly arranged at the lower ends of the first fixed frames 60, and the output ends of the first lower air cylinders 57 are connected with the downsides of the first rotating joints 58; the second fixed frames 77 are fixedly arranged below the sixth lower fixed plates 64; the third spline housings 70 are mounted inside the second fixed frames 77 by using bearings; the fourth belt wheels 72 and the fifth belt wheels 73 are fixedly arranged below the third spline housings 70; the third belt wheels 62 are connected with the fourth belt wheels 72 by the second synchronous belt 71; the third spline shafts 69 are matched with the third spline housings 70; the second lower brushes 67 are fixedly arranged at the top ends of the third spline shafts 69 by using the second crossed hinges 68; the second rotating joints 76 are fixedly arranged at the lower ends of the third spline shafts 69; the second lower air cylinders 80 are fixedly arranged below the second fixed frames 77, and the output ends of the second lower air cylinders 80 are connected with the downsides of the second rotating joints 76; the third lower servo motors 78 are fixedly arranged below the sixth lower fixed plates 64 by the transitional flanges, and the output ends of the third lower servo motors 78 are fixedly provided with the sixth belt wheels 74; the fifth belt wheels 73 are connected with the sixth belt wheels 74 by the third synchronous belt 75; the first lower rack 79 is fixedly arranged above the fifth lower fixed plates 56 and is engaged with the lower gear 25 during working; and the device includes the two sets of bilateral first burr brushing systems.

The second burr brushing systems are characterized in that the seventh lower fixed plates 82 are mounted above the fourth lower fixed plate 21 by the third lower guide rails 81; the eighth lower fixed plate 86 is fixedly arranged above the seventh lower fixed plates 82 by the third vertical plates 84; the second lower bearing blocks 85 are fixedly arranged on the eighth lower fixed plate 86; the first lower shafts 83 are mounted inside the second lower bearing blocks 85 by using bearings; the coil springs 87 are fixedly arranged above the first lower shafts 83; the plurality of brush bundles 89 are connected by the fourth lower guide rails 88; the plurality of brush bundles 89 and the fourth lower guide rails 88 are wound by the coil springs 87 to form a round; the third servo electric cylinders 93 are fixedly arranged on the eighth lower fixed plate 86; the conformal support frames 90 are mounted at the output ends of the third servo electric cylinders 93 by using the third crossed hinges 91; the upper ends of the lower slide blocks 92 are connected with the lower ends of the brush bundles 89 at the rightmost side; the lower ends of the lower slide blocks 92 are mounted below the eighth lower fixed plate 86 by the fifth lower guide rails 95; the fourth servo electric cylinders 94 are fixedly arranged below the eighth lower fixed plate 86, and the output ends of the fourth servo electric cylinders 94 are connected with the lower slide blocks 92; the second lower rack 96 is fixedly arranged at the right sides above the seventh lower fixed plates 82 and are engaged with the lower gear 25 when working; and the device includes the two sets of bilateral second burr brushing systems.

The synchronous clamping driving system is characterized in that the left sliding plate 31 and the right sliding plate 52 are mounted above the upper fixed plate 28 by the upper guide rail 30; the upper racks 29 are respectively fixedly arranged below the left sliding plate 31 and the right sliding plate 52; the upper gear 49 is fixedly arranged above the upper fixed plate 28 and is engaged with the upper racks 29; the first upper air cylinder 27 is fixedly arranged above the upper fixed plate 28, and the output end of the first upper air cylinder 27 is connected with the left sliding plate 31; the two left bearing blocks 33 are fixedly arranged above the left sliding plate 31; the two left shafts 32 are mounted inside the left bearing blocks 33 by using bearings; the V-shaped rollers 34 are respectively fixedly arranged above the two left shafts 32; the two right bearing blocks 51 are fixedly arranged above the right sliding plate 52; the right shafts 50 are mounted inside the right bearing blocks 51 by using bearings; the V-shaped rollers 34 are respectively fixedly arranged above the two right shafts 50; and the second servo motor 53 is fixedly arranged below the right sliding plate 52, and the output end of the second servo motor 53 is connected with one of the right shafts 50.

The upper burr brushing system is characterized in that the first upper bearing block 37 is fixedly arranged on a middle position below the upper lifting plate 41; the first upper shaft 36 is mounted inside the first upper bearing block 37 by using a bearing; the first upper brush 35 is fixedly arranged below the first upper shaft 36; the first servo motor 45 is fixedly arranged on the upper lifting plate 41, and the output end of the first servo motor 45 is connected with the upside of the first upper shaft 36; the second upper bearing block 40 is fixedly arranged at the left side below the upper lifting plate 41; the second upper shaft 39 is mounted inside the second upper bearing block 40 by using a bearing; the second upper brush 38 is fixedly arranged at the lower end of the second upper shaft 39; the third upper bearing block 46 is fixedly arranged at the right side below the upper lifting plate 41; the third upper shaft 47 is mounted inside the third upper bearing block 46 by using a bearing; the third upper brush 48 is fixedly arranged at the lower end of the third upper shaft 47; base plates of the first upper brush 35, the second upper brush 38 and the third upper brush 48 are shaped like gears, and the base plate of the first upper brush 35 is simultaneously engaged with the base plates of the second upper brush 38 and the third upper brush 48; the four upper guide sleeves 43 are fixedly arranged at the top end of the rack 1; the four upper guide posts 42 are engaged with the upper guide sleeves 43 and are fixedly arranged at the upper end of the upper lifting plate 41; and the two second upper air cylinder 44 are also fixedly arranged at the top end of the rack 1, and the output ends of the two second upper air cylinder 44 are hinged with the upside of the upper lifting plate 41.

In a working process, the first upper air cylinder 27 makes the four V-shaped rollers 34 synchronously clamp the wheel by virtue of the upper guide rail 30, the upper gear 49 and the upper racks 29; the second servo motor 53 makes the clamped wheel rotate by virtue of one of the right shafts 50; the second servo electric cylinders 54 make the first lower brushes 66 and the second lower brushes 67 lift to the back cavity of the wheel by virtue of the lower guide posts 2 and the lower guide sleeves 3 and also make the central brush 26 lift to the inside of a central hole of the wheel; and the second lower servo motor 12 makes the central brush 26 rotate by virtue of the first spline shaft 22, at the moment, burrs at the central hole may be removed.

The first lower air cylinders 57 make the first lower brushes 66 be in conformal contact with corresponding positions of the back cavity of the wheel by virtue of the second spline shafts 61 and the first crossed hinges 65; the second lower air cylinders 80 make the second lower brushes 67 be in conformal contact with corresponding positions of the back cavity of the wheel by virtue of the third spline shafts 69 and the second crossed hinges 68; the third lower servo motors 78 drive the third spline housings 70 and the second lower brushes 67 to rotate by virtue of the sixth belt wheels 74, the fifth belt wheels 73 and the third synchronous belt 75; the third spline housings 70 drive the fourth belt wheels 72 to rotate; the fourth belt wheels 72 drive the third belt wheels 62 and the second spline housings 63 to rotate by virtue of the second synchronous belt 71; and the second spline housings 63 drive the first lower brushes 66 to rotate.

According to the size of the back cavity of the wheel, the fourth servo electric cylinders 94 make the brush bundles 89 at the rightmost end move left and right by virtue of the fifth lower guide rails 95 and the lower slide blocks 92; each of the brush bundles 89 is tensioned by the coil spring 87 during rightward movement; the brush bundles 89 are automatically shrunk and tensioned by the coil springs 87 during leftward movement; the third servo electric cylinders 93 make the conformal support frames 90 lift by virtue of the third crossed hinges 91; and the conformal support frames 90 make the plurality of brush bundles 89 lift by virtue of the fourth lower guide rails 88 so that the shape of the back cavity of the wheel is adapted.

The first servo electric cylinders 15 make the sliding inclined blocks 16 move rightwards by virtue of the first lower guide rails 14; the sliding inclined blocks 16 make the fixed inclined blocks 18 and the lower gear 25 move upwards by virtue of the sliding guide rails 17, and the lower gear 25 is engaged with the first lower rack 79 and the second lower rack 96; the second lower servo motor 12 drives the first spline shaft 22 to rotate; the first spline shaft 22 drives the first spline housing 23 and the lower gear 25 to rotate; the left-right movement of the first lower brushes 66 and the second lower brushes 67 may be realized by virtue of the lower gear 25, the first lower rack 79 and the second lower guide rails 55; the whole left-right movement of each of the brush bundles 89 may be realized by virtue of the lower gear 25, the second lower rack 96 and the third lower guide rails 81; and the rotation of the first lower brushes 66, the second lower brushes 67 and each of the brush bundles 89 in the circumferential direction may be realized by the first lower servo motor 4 by virtue of the second belt wheel 8, the first belt wheel 6 and the first synchronous belt 7.

The first servo motor 45 makes the first upper brush 35 rotate by virtue of the first upper shaft 36; the base plate of the first upper brush 35 is simultaneously engaged with the base plates of the second upper brush 38 and the third upper brush 48, so that the simultaneous rotation of the second upper brush 38 and the third upper brush 48 may be realized; and the second upper air cylinder 44 are capable of making the first upper brush 35, the second upper brush 38 and the third upper brush 48 to move up and down by virtue of the upper guide posts 42 and the upper guide sleeves 43, and thus, burrs on the obverse side may be removed when the obverse side of the wheel is contacted.

The invention claimed is:

1. A wheel conformal burr brushing device, comprising a rack, four lower guide posts, four lower guide sleeves, a first lower servo motor, a first lower fixed plate, a first belt wheel, a first synchronous belt, a second belt wheel, a lower lifting plate, a hollow shaft, a hollow bearing block, a second lower servo motor, a second lower fixed plate, first lower guide rails, first servo electric cylinders, sliding inclined blocks, sliding guide rails, fixed inclined blocks, a third lower fixed plate, first vertical plates, a fourth lower fixed plate, a first spline shaft, a first spline housing, a first lower bearing block, a lower gear, a central brush, an first upper air cylinder, an upper fixed plate, upper racks, an upper guide rail, a left sliding plate, two left shafts, two left bearing blocks, V-shaped rollers, a first upper brush, a first upper shaft, a first upper bearing block, a second upper brush, a second upper shaft, a second upper bearing block, an upper lifting plate, four upper guide posts, four upper guide sleeves, two second upper air cylinder, a first servo motor, a third upper bearing block, a third upper shaft, a third upper brush, an upper gear, two right shafts, two right bearing blocks, a right sliding plate, a second servo motor, two second servo electric cylinders, second lower guide rails, fifth lower fixed plates, first lower air cylinders, first rotating joints, second vertical plates, first fixed frames, second spline shafts, third belt wheels, second spline housings, sixth lower fixed plates, first crossed hinges, first lower brushes, second lower brushes, second crossed hinges, third spline shafts, third spline housings, second synchronous belt, fourth belt wheels, fifth belt wheels, sixth belt wheels, third synchronous belt, second rotating joints, second fixed frames, third lower servo motors, a first lower rack, second lower air cylinders, third lower guide rails, seventh lower fixed plates, first lower shafts, third vertical plates, second lower bearing blocks, an eighth lower fixed plate, coil springs, fourth lower guide rails, brush bundles, conformal support frames, third crossed hinges, lower slide blocks, third servo electric cylinders, fourth servo electric cylinders, fifth lower guide rails, a second lower rack, a plurality of bearings, wherein, the wheel conformal burr brushing device comprises a lower lifting driving system, a central burr brushing system, a lower gear lifting unit, first burr brushing systems, second burr brushing systems, a synchronous clamping driving system and an upper burr brushing system, the lower lifting driving system is characterized in that the four lower guide sleeves are fixedly arranged on the first lower fixed plate; the four lower guide posts matched with the four lower guide sleeves are fixedly arranged below the lower lifting plate; the two second servo electric cylinders are fixedly arranged below the first lower fixed plate, and output ends of the two second servo electric cylinders are hinged with a downside of the lower lifting plate; the hollow bearing block is fixedly arranged above the lower lifting plate; the hollow shaft is mounted inside the hollow bearing block by using at least one of the bearings; the second lower fixed plate is fixedly arranged above the hollow shaft; the first belt wheel is fixedly arranged below the hollow shaft; the first lower servo motor is fixedly arranged below the lower lifting plate by using a transitional flange, and an output end of the first lower servo motor is fixedly provided with the second belt wheel; and the first belt wheel is connected with the second belt wheel by the first synchronous belt, the central burr brushing system is characterized in that the second lower servo motor is fixedly arranged below the fixed inclined blocks; the third lower fixed plate is fixedly arranged above the fixed inclined blocks; the first lower bearing block is fixedly arranged on the third lower fixed plate; the first spline housing is mounted inside the first lower bearing block by using at least one of the bearings; the lower gear is fixedly arranged above the first spline housing; the first spline shaft is matched with the first spline housing; the central brush is fixedly arranged above the first spline shaft; and an output end of the second lower servo motor is connected with a lower end of the first spline shaft, the lower gear lifting unit is characterized in that the sliding inclined blocks are mounted above the second lower fixed plate by the first lower guide rails; the first servo electric cylinders are fixedly arranged above the second lower fixed plate, and output ends of the first servo electric cylinders are connected with the sliding inclined blocks; the sliding inclined blocks are connected with the fixed inclined blocks by the sliding guide rails; the fourth lower fixed plate is fixedly arranged above the second lower fixed plate by the first vertical plates; and the device comprises four sets of lower gear lifting units uniformly distributed in a circumferential direction, the first burr brushing systems are characterized in that the fifth lower fixed plates are mounted above the fourth lower fixed plate by the second lower guide rails; the sixth lower fixed plates are fixedly arranged above the fifth lower fixed plates by the second vertical plates; the first fixed frames are fixedly arranged at the left sides below the sixth lower fixed plates; the second spline housings are mounted inside the first fixed frames by using at least one of the bearings; the third belt wheels are fixedly arranged below the second spline housings; the second spline shafts are matched with the second spline housings; the first lower brushes are fixedly arranged at top ends of the second spline shafts by using the first crossed hinges; the first rotating joints are fixedly arranged at lower ends of the second spline shafts; the first lower air cylinders are fixedly arranged at lower ends of the first fixed frames, and output ends of the first lower air cylinders are connected with downsides of the first rotating joints; the second fixed frames are fixedly arranged below the sixth lower fixed plates; the third spline housings are mounted inside the second fixed frames by using at least one of the bearings; the fourth belt wheels and the fifth belt wheels are fixedly arranged below the third spline housings; the third belt wheels are connected with the fourth belt wheels by the second synchronous belt; the third spline shafts are matched with the third spline housings; the second lower brushes are fixedly arranged at top ends of the third spline shafts by using the second crossed hinges; the second rotating joints are fixedly arranged at lower ends of the third spline shafts; the second lower air cylinders are fixedly arranged below the second fixed frames, and output ends of the second lower air cylinders are connected with downsides of the second rotating joints; the third lower servo motors are fixedly arranged below the sixth lower fixed plates by the transitional flanges, and output ends of the third lower servo motors are fixedly provided with the sixth belt wheels; the fifth belt wheels are connected with the sixth belt wheels by the third synchronous belt; the first lower rack is fixedly arranged above the fifth lower fixed plates and is engaged with the lower gear during working; and the device comprises two sets of bilateral first burr brushing systems, the second burr brushing systems are characterized in that the seventh lower fixed plates are mounted above the fourth lower fixed plate by the third lower guide rails; the eighth lower fixed plate is fixedly arranged above the seventh lower fixed plates by the third vertical plates; the second lower bearing blocks are fixedly arranged on the eighth lower fixed plate; the first lower shafts are mounted inside the second lower bearing blocks by using at least one of the bearings; the coil springs are fixedly arranged above the first lower shafts; the plurality of brush bundles are connected by the fourth lower guide rails; the plurality of brush bundles and the fourth lower guide rails are wound by the coil springs to form a round; the third servo electric cylinders are fixedly arranged on the eighth lower fixed plate; the conformal support frames are mounted at output ends of the third servo electric cylinders by using the third crossed hinges; upper ends of the lower slide blocks are connected with lower ends of the brush bundles at a rightmost side; lower ends of the lower slide blocks are mounted below the eighth lower fixed plate by the fifth lower guide rails; the fourth servo electric cylinders are fixedly arranged below the eighth lower fixed plate, and output ends of the fourth servo electric cylinders are connected with the lower slide blocks; the second lower rack is fixedly arranged at right sides above the seventh lower fixed plates and are engaged with the lower gear when working; and the device comprises the sets of bilateral second burr brushing systems, the synchronous clamping driving system is characterized in that the left sliding plate and the right sliding plate are mounted above the upper fixed plate by the upper guide rail; the upper racks are respectively fixedly arranged below the left sliding plate and the right sliding plate; the upper gear is fixedly arranged above the upper fixed plate and is engaged with the upper racks; the first upper air cylinder is fixedly arranged above the upper fixed plate, and an output end of the first upper air cylinder is connected with the left sliding plate: the two left bearing blocks are fixedly arranged above the left sliding plate: the two left shafts are mounted inside the left bearing blocks by using at least one of the bearings: the V-shaped rollers are respectively fixedly arranged above the two left shafts: the two right bearing blocks are fixedly arranged above the right sliding plate; the right shafts are mounted inside the right bearing blocks by using at least one of the bearings: the V-shaped rollers are respectively fixedly arranged above the two right shafts; and the second servo motor is fixedly arranged below the right sliding plate, and an output end of the second servo motor is connected with one of the right shafts, the upper burr brushing system is characterized in that the first upper bearing block is fixedly arranged on a middle position below the upper lifting plate: the first upper shaft is mounted inside the first upper bearing block by using at least one of the bearings: the first upper brush is fixedly arranged below the first upper shaft: the first servo motor is fixedly arranged on the upper lifting plate, and an output end of the first servo motor is connected with an upside of the first upper shaft: the second upper bearing block is fixedly arranged at a left side below the upper lifting plate: the second upper shaft is mounted inside the second upper bearing block by using at least one of the bearings: the second upper brush is fixedly arranged at a lower end of the second upper shaft: the third upper bearing block is fixedly arranged at a right side below the upper lifting plate: the third upper shaft is mounted inside the third upper bearing block by using at least one of the bearings; the third upper brush is fixedly arranged at a lower end of the third upper shaft; base plates of the first upper brush, the second upper brush and the third upper brush are shaped like gears, and the base plate of the first upper brush is simultaneously engaged with the base plates of the second upper brush and the third upper brush; the four upper guide sleeves are fixedly arranged at a top end of the rack; the four upper guide posts are engaged with the upper guide sleeves and are fixedly arranged at an upper end of the upper lifting plate: and the two second upper air cylinders are also fixedly arranged at the top end of the rack, and output ends of the two second upper air cylinders are hinged with an upside of the upper lifting plate.

* * * * *